US008621795B2

(12) United States Patent
Peterson

(10) Patent No.: US 8,621,795 B2
(45) Date of Patent: Jan. 7, 2014

(54) FENESTRATION FRAME WITH BONDED SUPPORT BRACKETS AND METHOD OF MAKING SAME

(75) Inventor: Steven G. Peterson, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 81 days.

(21) Appl. No.: 13/090,610

(22) Filed: Apr. 20, 2011

(65) Prior Publication Data

US 2011/0258947 A1 Oct. 27, 2011

Related U.S. Application Data

(60) Provisional application No. 61/327,156, filed on Apr. 23, 2010.

(51) Int. Cl.
*E06B 1/04* (2006.01)

(52) U.S. Cl.
USPC ..... 52/213; 52/204.55

(58) Field of Classification Search
USPC ..... 52/213, 834, 217, 204.599, 204.55
See application file for complete search history.

(56) References Cited

U.S. PATENT DOCUMENTS 3,238,679 A * 3/1966 Capoccia ..... 52/204.55
4,488,391 A * 12/1984 Pavnica ..... 52/745.16
5,881,510 A * 3/1999 Ole ..... 52/217
5,902,657 A * 5/1999 Hanson et al. ..... 428/36.92
6,260,320 B1 * 7/2001 Di Lorenzo ..... 52/414
6,265,037 B1 * 7/2001 Godavarti et al. ..... 428/34
6,293,061 B1 * 9/2001 Horak, Jr. ..... 52/213
6,357,197 B1 * 3/2002 Serino et al. ..... 52/834
6,895,718 B2 * 5/2005 Moffatt ..... 52/204.55
2007/0199665 A1 * 8/2007 Studney ..... 160/99
2009/0031635 A1 * 2/2009 Davis ..... 49/478.1
2010/0083597 A1 * 4/2010 Addison et al. ..... 52/204.53
2011/0258947 A1 * 10/2011 Peterson ..... 52/213

* cited by examiner

*Primary Examiner* — Basil Katcheves
(74) *Attorney, Agent, or Firm* — Womble Carlyle Sandridge & Rice, LLP

(57) ABSTRACT

A fenestration unit such as a window or door has a frame with an outer peripheral surface. An array of support brackets are secured to the outer peripheral surface and extend inwardly toward the interior of a building in which the fenestration unit is to be installed. The support brackets are formed with a bendable metal and are secured to the outer surface of the frame without forming holes in the frame through which water may leak. The support brackets may be secured by heat, sonic, or friction welding, or with solvents or adhesives, structural tapes, or other appropriate mechanisms. In one embodiment for use with frames having a vinyl surface, the support brackets may be vinyl coated steel to enable attachment of the support brackets with welding or vinyl adhesive techniques. A method of fabricating fenestration frames with support brackets includes obtaining support brackets and securing them to the fenestration frame without forming holes in the fenestration frame.

17 Claims, 3 Drawing Sheets

FENESTRATION FRAME WITH BONDED SUPPORT BRACKETS AND METHOD OF MAKING SAME

REFERENCE TO RELATED APPLICATION

Priority is hereby claimed to the filing date of U.S. provisional patent application No. 61/327,156 filed on 23 Apr. 2010.

TECHNICAL FIELD

This disclosure relates generally to fenestration units such as windows and doors and more specifically to fenestration unit frames having bendable support brackets or nailing tabs for securing and supporting fenestration units within a roughed-in opening.

BACKGROUND

Some fenestration units such as windows have frames with integral nailing flanges that project outwardly from the frame and substantially or partially surround the window. When installing such windows, the window is tilted into a roughed-in opening of a wall from the outside until the nailing flanges engage the outside sheathing of the wall. The window is leveled, plumed, and squared and nails or screws are driven through the nailing flanges and into the studs of the roughed-in opening to secure the window in place. The same may be true of other fenestration units such as doors.

In some applications, such as for large or heavy windows and windows to be installed in high wind prone regions, additional or alternative support systems are used to secure and support a window in a roughed-in opening. One such support system comprises an array of elongated bendable metal support brackets secured to the outer peripheral surfaces of a window frame with screws, staples, or other fasteners. The support brackets extend inwardly in the direction of the interior side of the window. To install the window, it is tilted into a roughed-in opening of a building and is leveled, plumed, and squared in the traditional manner. The support brackets are then bent outwardly to overly the studs and header and perhaps the rough sill of the roughed-in opening on the inside of the building. Nails or screws are driven through the support brackets and into the studs to secure and support the window in place. Again, the same may be true for other fenestration units such as doors.

Support brackets may be used in conjunction with or in the absence of traditional peripheral nailing flanges. In some cases, fenestration frames have integral brick mould attached to exterior edges of the frame and the brick mould rests against the exterior sheathing or studs of a roughed-in opening when the fenestration unit is tilted into place. These types of fenestration units can be secured with fasteners driven through the brick mould and/or through the jambs of the frame and into the adjacent studs. This fastening technique is sometimes referred to as "through-the-jamb fastening." Where fenestration units attached with through-the-jamb fastening or other traditional fastening techniques are large and heavy or need extra support, support brackets as described above may also be used to provide additional strength and support.

FIGS. 1 and 2 illustrate one support system that exemplifies the prior art within the context of a window. FIG. 1 shows a section of a wall 11 seen from the exterior of a building. The wall 11 comprises studs 13 to which exterior sheathing 16 is secured. A roughed-in window opening 12 is formed in the wall and is framed on its sides by studs 13, which may be jack studs 15 (FIG. 2), at its top by a header 14 (FIG. 2), and at its bottom by a rough sill (not visible) supported by cripple studs (not visible) extending upwardly from a sole plate. A window 17 is shown being tilted into the roughed-in opening 12 as indicated by arrow 26 for installing the window in the opening. The window 17 comprises a frame 18 that supports sashes 19. Brick mould 21 may be secured to the frame 19 around its outer edge or, alternatively, an integral nailing flange (not shown) may project outwardly from the frame 18 for securing the window in place from the outside. Alternatively still, neither brick mould nor peripheral flanges need be present.

An array of bendable metal support brackets 22 are secured at spaced locations around the frame 19 and extend inwardly from the interior edges of the window frame 18. The support brackets 22 are secured to the window frame 19 with fasteners 23, which typically comprise screws. A set of holes 24 are formed in the free end portions of the support brackets 22. During installation, the window 17 is tilted into the roughed-in opening, where it is leveled, plumed, and squared. Then, as illustrated in FIG. 2, the support brackets 22 are bent outwardly to overly the framing of the roughed-in opening. Fasteners, such as screws 27, are driven through one or more of the holes 24 and into the framing to secure the window firmly in place. Fasteners also may be driven through the brick mould or nailing flange if desired and/or through the frame, shims, and into the sides of studs framing the roughed-in opening. The window is thus mounted and secured in its roughed-in opening and significant additional support is provided by the support brackets.

The use of mechanical fasteners to secure support brackets to fenestration frames has certain disadvantages. Specifically, the fasteners themselves, typically screws, are relatively expensive. Further, the fastener holes in the fenestration frame must be sealed against water and moisture to prevent leakage and deterioration of the frame in the vicinity of the support brackets, and this process adds expense and manufacturing complexity. In addition, the heads of the fasteners project beyond the surfaces of the support brackets, which can cause problems during installation of the fenestration unit. FIGS. 3, 4, and 5 illustrate these disadvantages and show a metal support bracket 31 attached to a window frame 32 with four screws 33. In order to seal against any water migration beneath the support brackets and into the holes formed by the fasteners, gaskets 34 are disposed between the heads of the screws 33 and the outer surface of the bracket 31. Further, sealant 36, which also may be a gasket, is disposed between the support bracket 31 and the window frame to prevent direct water migration beneath the bracket. It will be better understood from these figures that the heads of the screws project significantly above the surface of the support bracket, that the cost of the fasteners and gaskets is high, and manufacturing time and resources required to install support brackets in this manner is extensive.

Managing air and water infiltration is one of the primary purposes of a window. Each hole that is formed in a window frame creates a unique opportunity for air or water to infiltrate in an undesirable way. This can be particularly true for windows having hollow window frames incorporating a "contain-and-drain" water management system. In such a system, water that may penetrate the primary weather stripping system is collected, redirected through the inside of the hollow window frame, and drained through slots or weep covers strategically located on the frame or sill. If fastener holes from support bracket attachment are located in the water drainage conduits of the frame, water may leak out through these holes into undesirable regions, such as onto framing studs or between interior and exterior walls, which can lead to rot or mold. In these types of windows, extra attention must be applied to sealing around the fasteners to prevent such problems.

There exists a need for a bendable support bracket and attachment methodology for fenestration units such as windows and doors that successfully addresses and solves the above and other disadvantages and shortcomings. It is to the provision of such a support bracket and attachment method and to a fenestration unit that incorporates such that the present disclosure is primarily directed.

SUMMARY

U.S. provisional patent application No. 61/327,156; to which priority is claimed above, is hereby incorporated by reference in its entirety.

The invention will be exemplified herein primarily within the context of a window unit for purposes of clarity. It will be understood, however, that the descriptions that follow apply equally to other types of fenestration units such as doors, transoms, sidelights, and others and is not limited to windows.

Briefly described, a support bracket for windows, including vinyl, vinyl clad, aluminum, composite, fiberglass, painted, and unpainted frame windows, is formed from a bendable metal such as steel. In one embodiment for vinyl or vinyl surface window frames, the steel may have an exterior vinyl coating. In this embodiment, the exterior vinyl coating of the support bracket is bondable to a vinyl or vinyl clad window frame in any number of ways such as with vinyl adhesives or through sonic or other welding techniques, none of which require that mechanical fasteners be driven into the frame or that holes be formed in the frame. In other embodiments for non-vinyl window frames such as painted window frames, extruded window frames, pultruded fiberglass window frames, and composite window frames made, for example, of Fibrex® material, the support bracket need not have a vinyl coating (although it may). For these and other non-vinyl window frames, the support brackets may be bare metal without a coating, or may be galvanized or otherwise coated to resist oxidation. In such instances, the support brackets may be bonded to the window frame with an appropriate adhesive, a structural tape, or other bonding mechanism not requiring screws or other fasteners or holes in the frame.

Thus, a fenestration unit is now provided having bendable support brackets for mounting and securing the unit in a roughed-in opening but without any holes, other penetrations, or fasteners extending into the frame of the fenestration unit. Accordingly, with the present invention, the cost of fasteners is eliminated, the requirement to seal around fasteners and the support bracket is eliminated, there are no projections above the surface of the support bracket, and no holes are formed in the frame of the fenestration unit. The invention will be better understood upon review of the detailed description set forth below taken in conjunction with the accompanying drawing figures, which are briefly described as follows.

DETAILED DESCRIPTION

The invention will be described in part within the context of one exemplary embodiment wherein the support bracket has a metal core coating in a vinyl material. This exemplary embodiment is particularly suitable for use with vinyl or vinyl clad window frames where the vinyl coating of the support bracket can be adhered or welded to the vinyl surface of the window frame. However, as mentioned above, this is only one embodiment and the invention is not limited to vinyl coated support brackets or window frames with vinyl surfaces.

Figure 1:
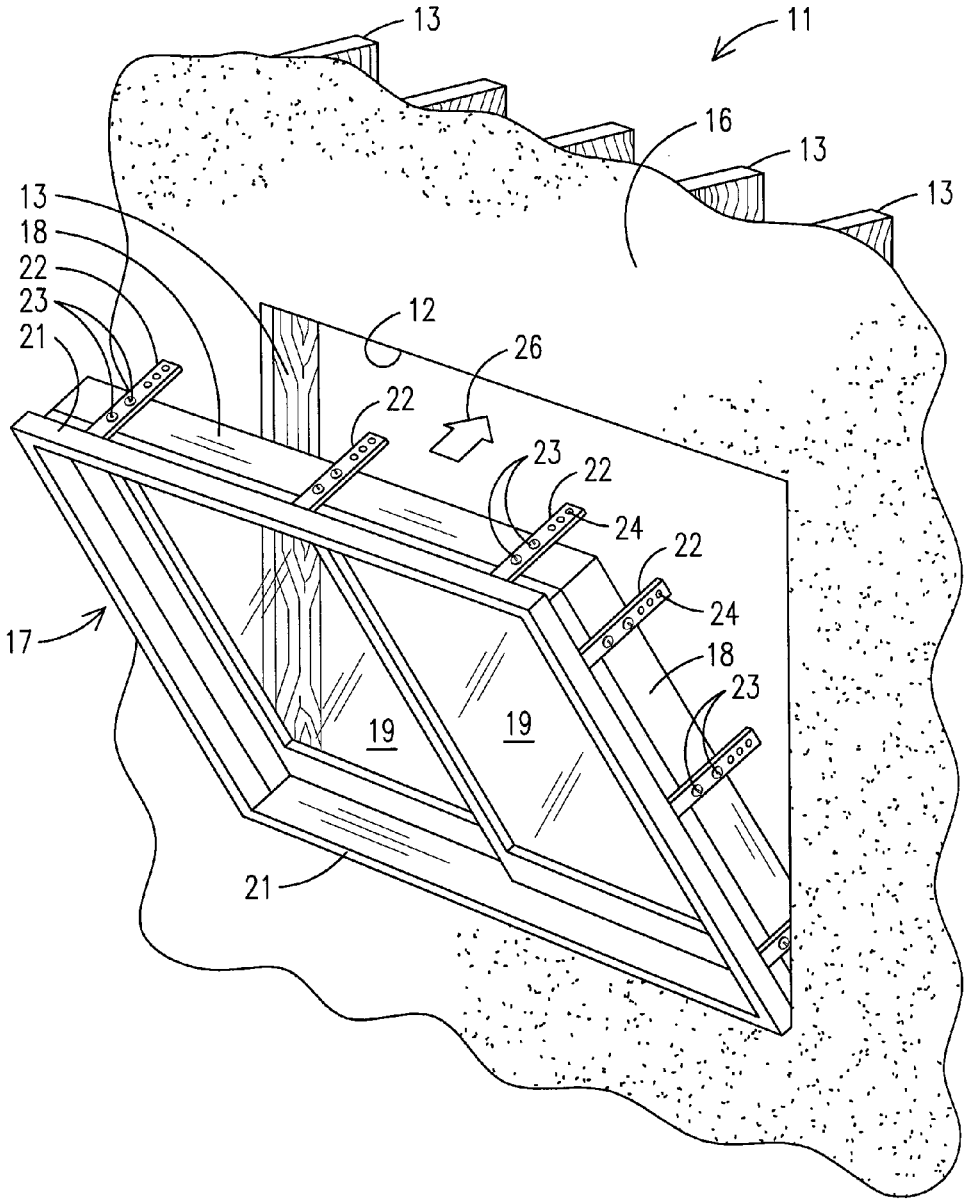
FIG. 1 PRIOR ART
FIGS. 1 and 2, which are referenced above, illustrate a typical prior art installation of a window using metal support brackets.
Figure 2:
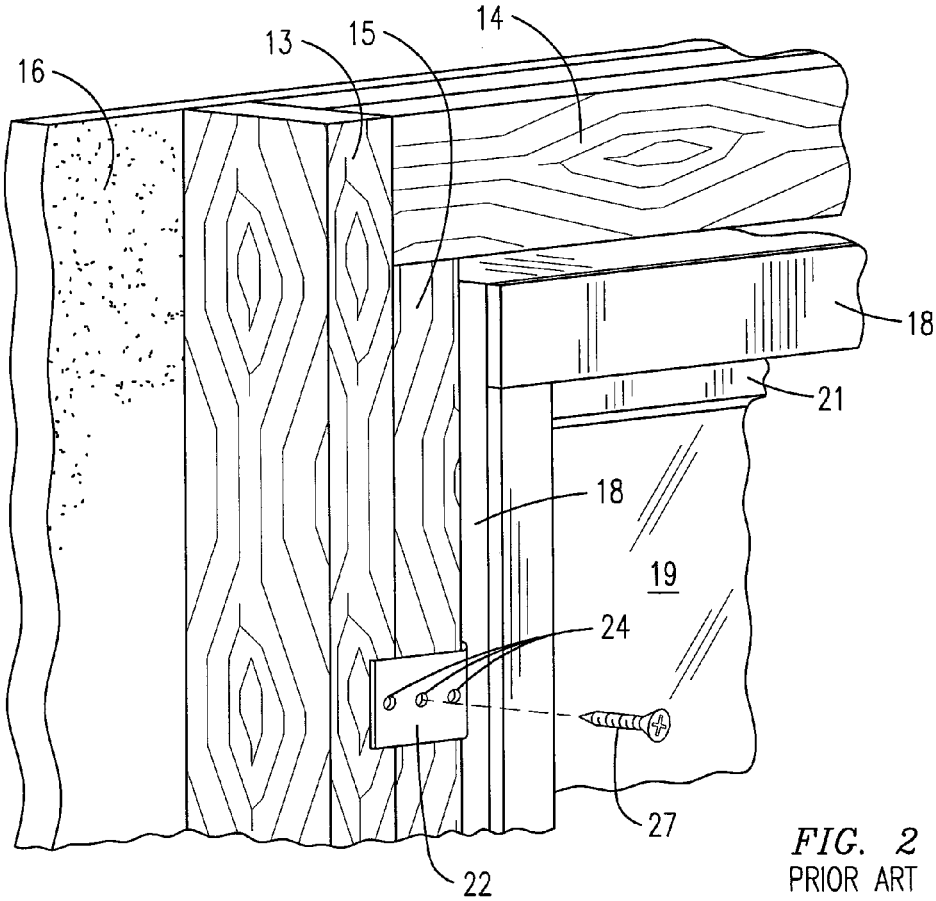
FIG. 2 PRIOR ART
Figure 3:
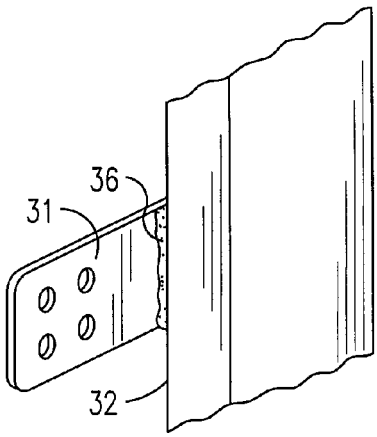
FIG. 3 PRIOR ART
FIGS. 3 through 5, also referenced above, illustrate a traditional method of attaching a metal support bracket to a window frame with screws and typical techniques for sealing against water leakage at the screw holes.
Figure 4:
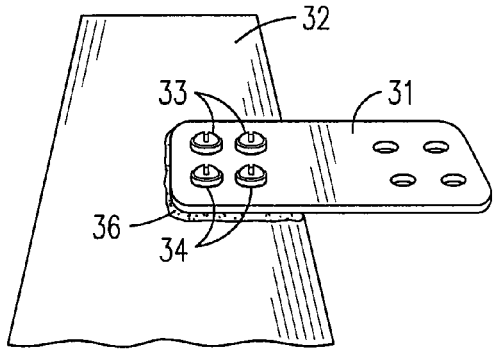
FIG. 4 PRIOR ART
Figure 5:
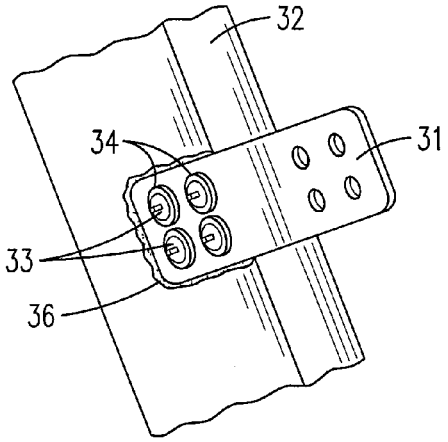
FIG. 5 PRIOR ART
Figure 6:
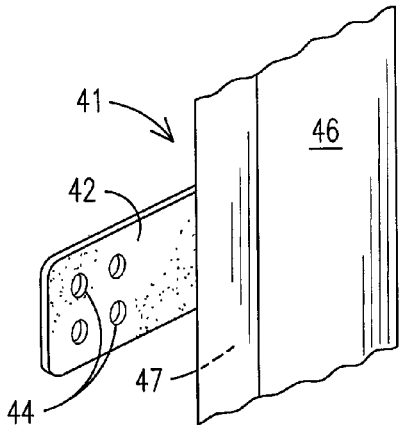
FIGS. 6 through 8 illustrate a support bracket and method of attachment of the bracket to a window frame according to one exemplary embodiment of the invention.
Figure 7:
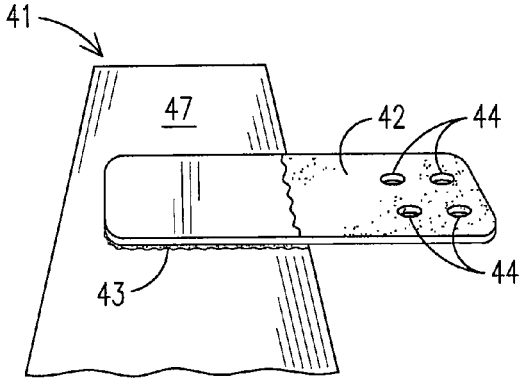
Figure 8:
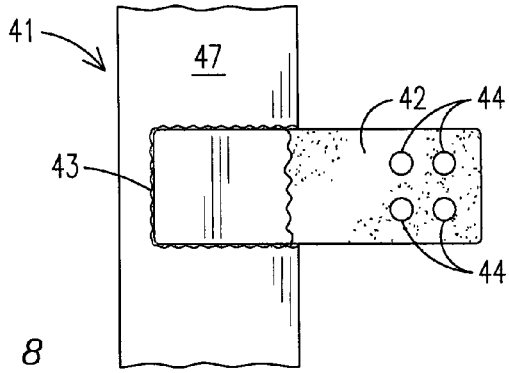

Referring now in more detail to the exemplary embodiment shown in FIGS. 6 through 8, wherein like reference numerals indicate like parts throughout the various views, a window frame 41 has an inner surface 46 and an outer surface 47. The outer surface 47 resides, when the window is installed in a roughed-in opening, adjacent the studs of the roughed-in opening. The inner surface supports or has features that support a sash or sashes of the window. The window frame may be constructed from extruded vinyl lineals, may be formed with a wood or composite core that may or may not be clad with a vinyl exterior skin, or may be an extruded or pultruded composite material such as a Fibrex® brand composite of Andersen Corporation.

A support bracket 42 is secured to the outer surface 47 of the frame 41 and extends inwardly from the frame in the direction of the interior of a building in which the window is to be installed. The support bracket 42 is bendable and is used to secure the window to the surrounding studs of a roughed-in opening in which the window of the frame is installed, generally in the manner described above. For this purpose, the support bracket may be supplied with holes 44 to receive nails, staples, or screws for attaching the support bracket to the studs.

The support bracket preferably comprises bendable steel (or other metal) and may or may not have a vinyl skin or coating that covers and is bonded to at least a portion of one of its surfaces, a product known as vinyl coated steel. Vinyl coated steel is sometimes used in the appliance industry as appliance panels and other components and is commercially available in a variety of forms and colors from companies such as Clad-Rex, Inc., 11500 West King Street, Franklin Park, Ill. 60131. The vinyl coating of such products is permanently bonded to the surface of the steel in such a way that the coating does not easily delaminate and the product can be bent and formed into parts generally in the same manner as bare steel. Among other things, the coating provides a surface that protects the steel core from oxidation and corrosion and, for products where it is visible, provides a surface that is visually pleasing and that can be colored or textured according to the needs of a user.

For the present purpose, the support brackets obviously are not visible when a building is complete such that the color of the vinyl coating is not important. In this regard, the support brackets may be recycled from scrap vinyl coated steel from other industries if desired, which is "green" and ecologically responsible. Further, the vinyl coating need only be applied to a surface of the support bracket, or a portion of that surface, that contacts the surface of a window frame. Alternatively, all surfaces of the support bracket may be coated with vinyl if desired to provide enhanced corrosion protection.

For embodiments not intended for use with window frames having a vinyl surface, it is not necessary for the support brackets to be vinyl coated, although they may be if desired. In these embodiments, the support brackets may be bare metal, coated with a protective coating, galvanized, or otherwise protected from corrosion. In any case, the surfaces of the support brackets are compatible with and securely bondable to the material of the window frame surface to which they are to be attached.

The support bracket 42 of this invention is uniquely and permanently secured to the outer surface 47 of a window frame 41 not with fasteners that extend into the frame, but by permanently bonding the support bracket to the outer surface of the window frame. This bonding can be achieved in a variety of ways. For example, where the window frame is vinyl or has a vinyl surface, the support brackets may be secured to the frame with heat bonding, friction or sonic welding, or application of solvents or vinyl adhesives to the mating surfaces. For non-vinyl surface frames, the bonding mechanism is specific to the combination of surfaces being bonded (e.g. painted, unpainted, vinyl capped, acrylic capped, galvanized, plated, etc.) Examples of adhesives for these applications include, without limitation, epoxy's, acrylic adhesives, and urethane adhesives. Other mechanisms such as structural tapes also may be employed.

Regardless of the bonding method, the support bracket 42 is and becomes securely and integrally attached and bonded to the frame as if mechanical fasteners had been used. However, because no mechanical fasteners are used, there are no holes formed in the frame and thus no sealant or washers are required as in the past to try and prevent water from penetrating or seeping through the holes. This is particularly pertinent for window and door frames of the contain-and-drain type, where water is often directed through internal channels formed in the frame and can seep out through holes formed by fasteners extending into these channels, as discussed above.

The support bracket of the invention provides advantages in addition to the elimination of fastener holes in a window or door frame. More specifically, the cost of screws, washers, and sealant used in the past is completely eliminated, as is the time, skill, and equipment needed to install them during manufacturing. Further, as can be seen in FIGS. 6 through 8, the support bracket, when attached, is virtually flush with the outer surface of the frame and the protrusions resulting from the use of screws and washers in the past are not present. Finally, for the vinyl coated metal embodiment, the vinyl coating on the support brackets protects the brackets against oxidation and corrosion and may render the brackets easier to manipulate during installation of a window or door. A solution is thus now presented that addresses and solves virtually all of the problems and shortcomings of prior art support brackets described above.

The invention has been described herein in terms of preferred embodiments and methodologies considered by the inventor to represent the best modes of carrying out the invention. It will be understood by skilled artisans, however, that a wide range of additions, deletions, and modifications, both subtle and gross, may be made to the illustrated embodiments without departing from the spirit and scope of the invention. For example, while steel has been presented as a preferred material of the support brackets, other metals such as aluminum, copper, stainless, and the like might be substituted with comparable results. In the vinyl coated steel embodiment, the vinyl coating may be any vinyl formulation that is compatible with and bondable to the vinyl surface of a vinyl, vinyl clad, or vinyl composite window or door frame. Polyvinylchloride (PVC) is one example. Environmentally friendly polymers polylactic acid (PLA) and other plant derived polymers also may be used. The described exemplary embodiments show support brackets extending from fenestration frames in an interior direction to be secured to wall studs on the interior of a building, which is common. It will be understood by the skilled artisan, however, that they may just as well extend in an exterior direction for attachment to a wall surrounding a roughed-in opening on the exterior of a building, and such is encompassed by the invention. Finally, while a single support bracket is illustrated in FIGS. 6 through 8, it will be understood that a typical window or door frame may have an array of such brackets disposed around its periphery. The brackets of this invention may be used to provide support for windows attached in any traditional manner to the framing of a building structure. These and other modifications, additions, and deletions should be considered to be encompassed within the scope of the present invention, which is constrained only by the claims.

What is claimed is:

1. A fenestration unit having an interior side and an exterior side and comprising:

a frame having a substantially planar outer surface between the interior side and the exterior side; and at least one support bracket bonded and secured to the substantially planar outer surface and extending therefrom in an interior direction or an exterior direction for securing the fenestration unit in a roughed-in opening, the support bracket being bonded and secured only to the substantially planar outer surface and without the presence of holes, other penetrations, or fasteners that extend into the frame;

wherein the support bracket comprises a metal core with a vinyl coating bonded thereto.

2. The fenestration unit of claim 1 and wherein the fenestration unit is a window.

3. The fenestration unit of claim 1 and wherein the fenestration unit is a door.

4. The fenestration unit of claim 1 and wherein the frame comprises vinyl.

5. The fenestration unit of claim 1 and wherein the frame comprises a vinyl composite.

6. The fenestration unit of claim 1 and wherein the frame comprises a vinyl clad frame.

7. The fenestration unit of claim 1 and wherein the vinyl coating is bonded to less than all surfaces of the metal core.

8. The fenestration unit of claim 1 and wherein the frame has an outer surface and the support bracket is bonded to the outer surface and extends toward the interior of a building when the fenestration unit is positioned in a roughed-in opening of the building.

9. The fenestration unit of claim 8 and wherein the support bracket is secured to the outer surface of the frame by heat welding, sonic welding, friction welding, solvents, structural tapes, or adhesives.

10. The fenestration unit of claim 1 and wherein the outer surface of the frame is substantially flat.

11. The fenestration unit of claim 10 and wherein each of the plurality of support brackets is substantially planar prior to being bent against and secured to the framing.

12. A fenestration unit having an interior side and an exterior side and comprising:

a frame having a substantially planar outer surface between the interior side and the exterior side; and at least one support bracket bonded and secured to the substantially planar outer surface and extending therefrom in an interior direction or an exterior direction for securing the fenestration unit in a roughed-in opening, the support bracket being bonded and secured only to the substantially planar outer surface and without the presence of holes, other penetrations, or fasteners that extend into the frame;

wherein the surface of the frame at least at the location where the support bracket is bonded is selected from the group consisting of wood, paint, acrylic capped, metal, and a wood composite.

13. A fenestration unit having a frame with a substantially planar outer surface extending around a periphery thereof and a plurality of support brackets, each of the plurality of support brackets having a proximal portion that is bonded and secured only to the substantially planar outer surface without holes or fasteners that extend into the frame, and a distal portion extending in a direction generally transverse to a plane of the fenestration unit to be bent against and secured to the framing of a roughed-in opening in which the fenestration unit is to be positioned to support and secure the fenestration unit within the roughed-in opening;

wherein the frame comprises a vinyl outer surface;

wherein the proximal portions of the plurality of support brackets comprise a vinyl outer surface; and wherein the support brackets further comprise a metal core.

14. The fenestration unit of claim 13 and wherein the support brackets are bonded flush to the outer surface of the frame by an attachment mechanism selected from the group consisting of heat welding, sonic welding, solvents, adhesives, acrylic adhesives, urethane adhesives, adhesive tapes, and structural tapes.

15. The fenestration unit of claim 13 and wherein the vinyl outer surfaces of the support brackets are bonded to the vinyl outer surface of the frame.

16. The fenestration unit of claim 15 and wherein the support brackets are bonded by welding, solvents, adhesives, tapes, or a combination thereof.

17. The fenestration unit of claim 13 and wherein the fenestration unit has an interior side and an exterior side and wherein the support brackets extend generally in an interior direction with respect to a plane of the fenestration unit to be attached to framing studs on the interior of a building.

* * * * *